US006824176B2

(12) United States Patent
Spurr et al.

(10) Patent No.: US 6,824,176 B2
(45) Date of Patent: Nov. 30, 2004

(54) LATCH ARRANGEMENT

(75) Inventors: Nigel Victor Spurr, West Midlands (GB); Stephen John Wright, West Midlands (GB)

(73) Assignee: Meritor Light Vehicle Systems (UK) Limited (GB)

( * ) Notice: Subject to any disclaimer, the term of this patent is extended or adjusted under 35 U.S.C. 154(b) by 0 days.

(21) Appl. No.: 10/022,674

(22) Filed: Dec. 20, 2001

(65) Prior Publication Data

US 2002/0084657 A1 Jul. 4, 2002

(30) Foreign Application Priority Data

Dec. 20, 2000 (GB) ..... 0031060

(51) Int. Cl.[7] ..... E05C 3/06
(52) U.S. Cl. ..... 292/201; 292/216
(58) Field of Search ..... 292/201, 216

(56) References Cited

U.S. PATENT DOCUMENTS

| | | | | | |
|---|---|---|---|---|---|
| 709,607 | A | * | 9/1902 | Podlesak | 49/2 |
| 971,423 | A | * | 9/1910 | Walters | 292/201 |
| 1,057,608 | A | * | 4/1913 | Wumb et al. | 292/201 |
| 1,238,345 | A | * | 8/1917 | Schoenle | 292/201 |
| 1,309,645 | A | * | 7/1919 | Lopez | 292/198 |
| 1,949,850 | A | * | 3/1934 | Williard | 292/341.16 |
| 2,081,055 | A | * | 5/1937 | Kiracofe | 292/201 |
| 2,219,132 | A | * | 10/1940 | Hohmann et al. | 292/45 |
| 2,369,362 | A | * | 2/1945 | Marziani | 100/319 |
| 3,942,828 | A | * | 3/1976 | Bourrie et al. | 292/201 |
| 4,624,491 | A | * | 11/1986 | Vincent | 292/201 |
| 4,802,350 | A | | 2/1989 | Periou | |
| 5,894,906 | A | | 4/1999 | Weber | |
| 5,944,367 | A | * | 8/1999 | Imaizumi et al. | 292/201 |
| 6,116,664 | A | | 9/2000 | Wegner | |
| 6,123,371 | A | * | 9/2000 | Fisher | 292/216 |
| 6,157,090 | A | | 12/2000 | Vogel et al. | |

FOREIGN PATENT DOCUMENTS

| | | |
|---|---|---|
| DE | 1816942 | 7/1970 |
| GB | 2 196 378 | 4/1988 |
| GB | 2 349 171 | 10/2000 |
| GB | 2 350 644 | 12/2000 |

* cited by examiner

*Primary Examiner*—Daniel P. Stodola
*Assistant Examiner*—Carlos Lugo
(74) *Attorney, Agent, or Firm*—Carlson, Gaskey & Olds

(57) ABSTRACT

A latch arrangement includes a latch, a manually actuable element, a release mechanism and an electromagnet. The latch is operable to releasably retain a striker. The release mechanism is capable of being moved by the manually actuable element from a latched position to an unlatched position such that the manually actuable element unlatches the latch. The electromagnet includes first, second and third conditions. The first condition is a non-powered condition and actuation of the manually actuable element does not cause the release mechanism to unlatch the latch. The second condition is a powered condition and actuation of the manually actuable element does not cause the release mechanism to unlatch the latch. The third condition is in a non-powered condition and actuation of the manually actuable element causes the release mechanism to unlatch the latch.

20 Claims, 6 Drawing Sheets

LATCH ARRANGEMENT

This application claims priority to United Kingdom (GB) patent application number 0031060.7 filed on Dec. 20, 2000.

BACKGROUND OF THE INVENTION

The present invention relates to latch arrangements, and in particular latch arrangements for use within doors of cars (automobiles).

Known car doors include latches for releasably retaining the car door in a closed position. Such latches can be locked when the car is left unattended or even when an occupant is in the vehicle so as to prevent access to the vehicle by unauthorized people.

Such latches can be moved between a locked and unlocked condition either by manual means such as by operating an inside sill button or an exterior key barrel, or they can be powered between the locked and unlocked conditions by a power actuator, which can be controlled remotely by, for example, infra red devices.

A problem with such power locking/unlocking is that in the event that power is lost e.g. during a road traffic accident or as a result of a flat battery, it may not be possible to change the state of the lock. Thus where a vehicle is in use and the doors are locked and the vehicle is involved in a road traffic accident, the occupant of the vehicle may find themselves locked in the vehicle immediately following the crash and this clearly has safety implications. Furthermore, the power actuator is expensive to produce and manufacture. An object of the present invention is to provide an improved form of latch arrangement.

Thus according to the present invention there is provided a latch arrangement including a latch, a manually actuable element, a release mechanism and a power control means, the latch being operable to releasably retain a striker in use, the release mechanism being capable of being moved by the manually actuable element from a latched position to an unlatched position wherein it unlatches the latch, the power control means having a first, second and third condition. The first condition is a non powered condition and actuation of the manually actuable element does not cause the release mechanism to unlatch the latch.

The second condition is a powered condition and actuation of the manually actuable element does not cause the release mechanism to unlatch the latch. The third condition the power control means is in a non powered condition and actuation of the manually actuable element causes the release mechanism to unlatch the latch.

BRIEF DESCRIPTION OF THE DRAWINGS

The invention will now be described, by way of example only, with reference to the accompanying drawings in which.

DETAILED DESCRIPTION OF THE DRAWINGS

Figure 1:
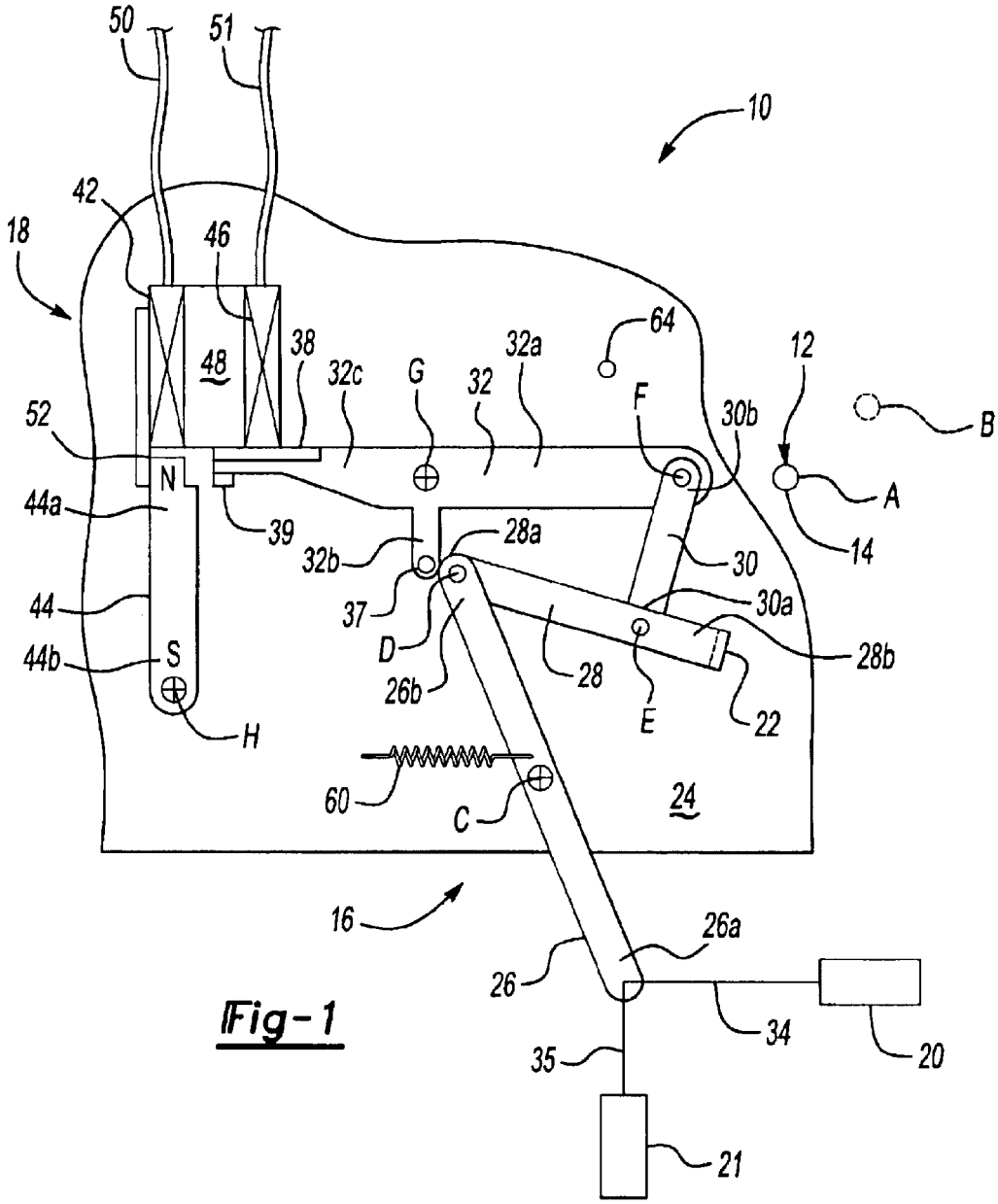
FIG. 1 is a view of a latch arrangement according to the present invention.

With reference to the FIGS. 1 to 4 there is shown a latch arrangement 10 having a latch 12 (only part of which is shown), a release mechanism 16, powered control means 18 and manually actuable elements in the form of inside handle 20 and outside handle 21.

The latch 12 is mounted on a car door and is operable to releasably retain a striker mounted on fixed structure of the car, such as a B post or a C post. The latch 12 typically might include a latch bolt in the form of a rotating claw which engages the striker. To ensure the claw retains the striker, a pawl can be provided to retain the latch bolt in its closed position. The pawl includes a latch release element in the form of a pawl pin 14.

With the pawl pin 14 in position A as shown in FIG. 1, closing of the door will cause the rotating claw to engage the striker and the pawl will then retain the striker in the closed position. Movement of the pawl pin 14 to the position B as shown in FIG. 1 will release the pawl from engagement with the claw thus allowing the striker to be released from the claw and allowing the door to open. Thus with the pawl pin in the position A of FIG. 1 the latch can be latched to the striker and with the pawl pin in the position B of FIG. 1 the latch can be unlatched from the striker.

The release mechanism includes release lever 26, release link 28, connector link 30 and lock/unlock lever 32. Release lever 26 is pivotally mounted about pivot C on chassis 24 of the latch arrangement. One end 26A of release lever 26 is connected via linkage 34 (shown schematically) to a manually actuable element in the form of an inside handle 20.

End 26A is further connected by a further linkage 35 (shown schematically) to a further manually actuable element in the form of an outside door handle 21.

Operation of either handle 20 or 21 causes the release lever to rotate clockwise about pivot C. End 26B of release lever 26 is connected via pivot D to end 28A of release link 28. End 28B of release link 28 includes an abutment 22 for engagement with pawl pin 14 as will be further described below.

Release link 28 is connected to end 30A of connector 30 by pivot E which is positioned between end 28A and 28B. End 30B of connector 30 is connected to end of arm 32A of lock/unlock lever 32 by a pivot F.

Lock/unlock lever 32 further includes arm 32B having pin 37 and arm 32C having abutment 38 and 39. Lock/unlock lever 32 is pivotally mounted about pivot G onto chassis 24.

Look/unlock lever 32 is made from mild steel and hence in particular abutment 38 is made from a ferromagnetic material though in further embodiments this need not be the case (see below). Powered control means 18 includes electromagnet 42 and magnet pawl 44.

Electromagnetic 42 is mounted on chassis 24 and includes windings 46, core 48 and electric leads 50 and 51. Pawl stop 52 is provided on one side of the electromagnet 42.

Magnetic pawl 44 includes a permanent magnet and is pivotally mounted about pivot H onto chassis 24. End 44A of pawl 44 includes abutment 54, 56 and 58, which will be further described below.

A tension spring 60 is connected to chassis 24 and release lever 26 and acts to bias release lever 26 in an anticlockwise direction when viewing FIG. 1.

A further tension spring 62 (only shown in FIG. 3 for clarity) biases pin 37 and pivot 38 together.

In further embodiments different forms of springs can be used in particular springs acting in torsion (clock springs) in place of tension springs 60 and 62 to perform the same biasing action.

A lock/unlock lever stop 64 is mounted on the chassis 24.

As a result of tension spring 62 end 28A of release link 28 is biased into engagement with pin 37. In further embodiments the end of release lever 26 could engage pin 37 as could a part of pivot D.

Magnetic pawl 44 has a south pole S at end 44B and a north pole N at end 44A.

Applying DC current to the windings 46 via electric leads 50 and 51 in a first direction will create a magnetic field around the electromagnet which will bias the north pole in end 44A of magnetic pawl 44 to the left when viewing FIG. 1 i.e. anticlockwise about pivot H until abutment 54 engages pawl stop 52.

Figure 1A:
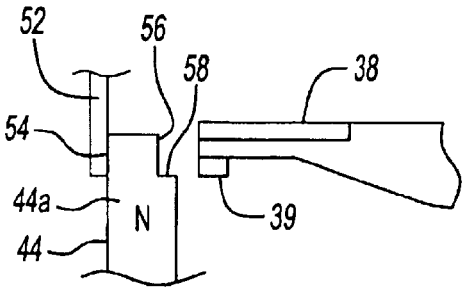
FIG. 1A is an enlarged view of part of the FIG. 1
Figure 1B:
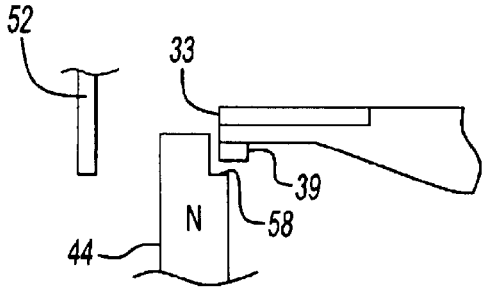
FIG. 1B is a view similar to FIG. 1A with the magnetic pawl in a different position.

Applying DC current in a second direction to windings 46 via electric 50 and 51 will cause a different magnetic field to form around the electromagnet such that north pole end 44A of magnetic pawl 44 is biased to the right when viewing FIG. 1 i.e. clockwise around pivot H until such time as abutment 56 engages end 33 of arm 32C of lock/unlock lever 32 (see FIG. 1B). Under these conditions abutment 58 is opposite abutment 39 and will prevent rotation of lock/unlock lever 32 anticlockwise about pivot G (see below).

Note that to move the magnetic pawl between the positions as shown in FIGS. 1A and 1B it is only necessary to apply a short pulse (e.g. 50 ms) of current to windings 46 in the appropriate direction since under normal circumstances once the magnetic pawl 44 has achieved one of the positions as shown in FIG. 1A or 1B there are no forces which tend to move it out of that positions.

Note that in a preferred embodiment the center of gravity of pawl 44 is substantially at pivot H since, in the event of a road traffic accident, such an arrangement will not tend to rotate the pawl as a result of acceleration or deceleration occurring during the accident.

Note that in a further preferred embodiment a relatively light detent is provided to maintain the magnetic pawl 44 in either of the positions as shown in FIG. 1A and FIG. 1B which can nevertheless be overcome by manual operation of the key or by pulsing the electromagnet.

It is also possible to prevent rotation of lock/unlock lever 32 anticlockwise about pivot G by applying and maintaining DC current in the first direction to windings 46 since abutment 38 is made from a ferromagnetic material and will therefore be magnetically attracted to electromagnet 42.

The powered control means 18 has three conditions namely a first condition at which no power is applied to the windings and the magnetic pawl 44 is in the position as shown in FIG. 1B.

A second condition at which power is supplied and maintained in a first direction to windings 46 thus attracting abutment 38 and ensuring that the magnetic pawl 44 is positioned as shown in FIGS. 1 and 1A.

A third condition at which no power is supplied to the windings 46 and the magnetic pawl 44 is in position as shown in FIGS. 1 and 1A.

It is important to note that in this case the physical position of various components when in the second and third conditions is the same. Thus the second and third conditions differ only in that in the second condition power is supplied to windings 46 and in the third condition no power is supplied.

Operation of the latch arrangement is as follows. With the control means 18 in the third condition the door can be manually opened as follows. As mentioned previously with the control means in the third condition the magnetic pawl is positioned as shown in FIG. 1 and thus does not restrict rotation of the lock/unlock lever 32 in an anticlockwise direction. Furthermore, no power is supplied to the windings 46 and thus the electromagnet also does not restrict movement of the lock/unlock lever 32 in an anticlockwise direction. Initial movement of either the inside handle 20 or outside handle 21 moves the release lever 26 in a clockwise direction about pivot C to the unlocked position as shown in FIG. 2.

It should be noted that lock/unlock lever has rotated anticlockwise about pivot G to a position where arm 32A has come into abutment with abutment 64. It should also be noted that abutment 38 has become disengaged from the electromagnet 42.

Figure 2:
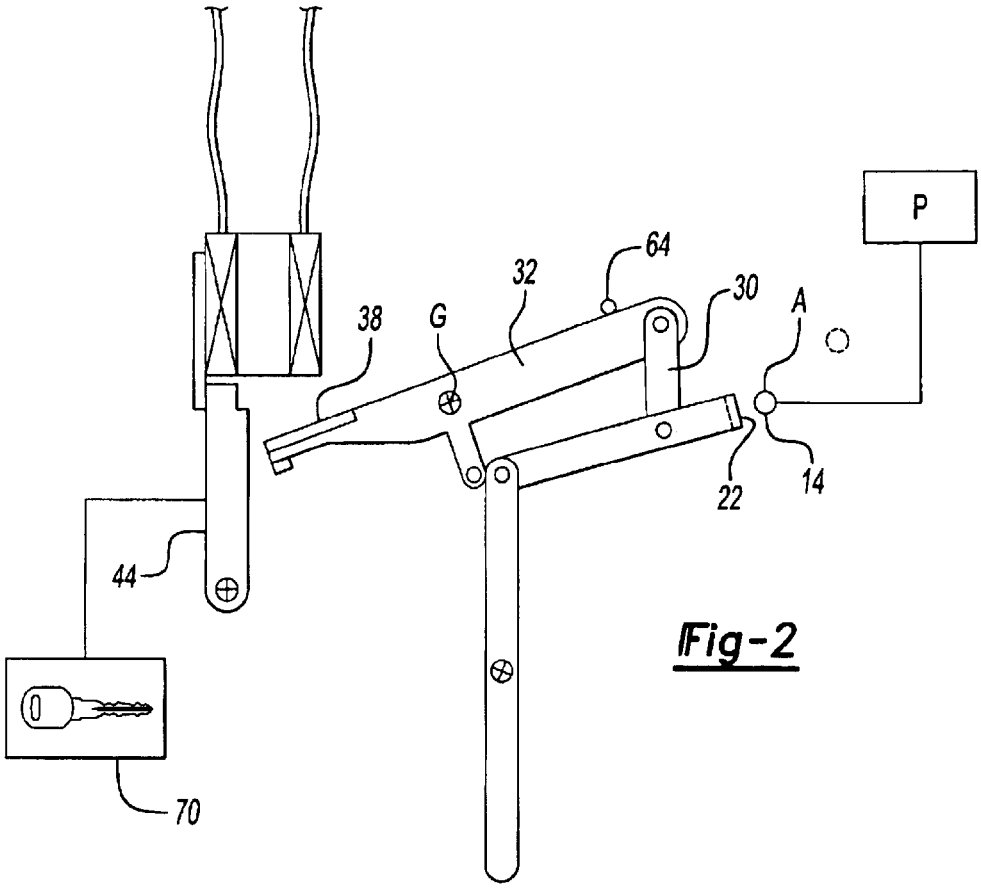
FIG. 2 shows the latch arrangement of FIG. 1 part way through an opening operation in an unlocked but latched condition.

It can also be seen from FIG. 2 that end 28A of release link 28 has remained in contact with pin 37. Thus connector 30 and release link 28 have also substantially rotated about pivot G. Note that as shown in FIG. 2 abutment 22 had become aligned with pawl pin 14. This can be contrasted with the position of abutment 22 as shown in FIG. 1 where it is not aligned with pawl pin 14.

Figure 3:
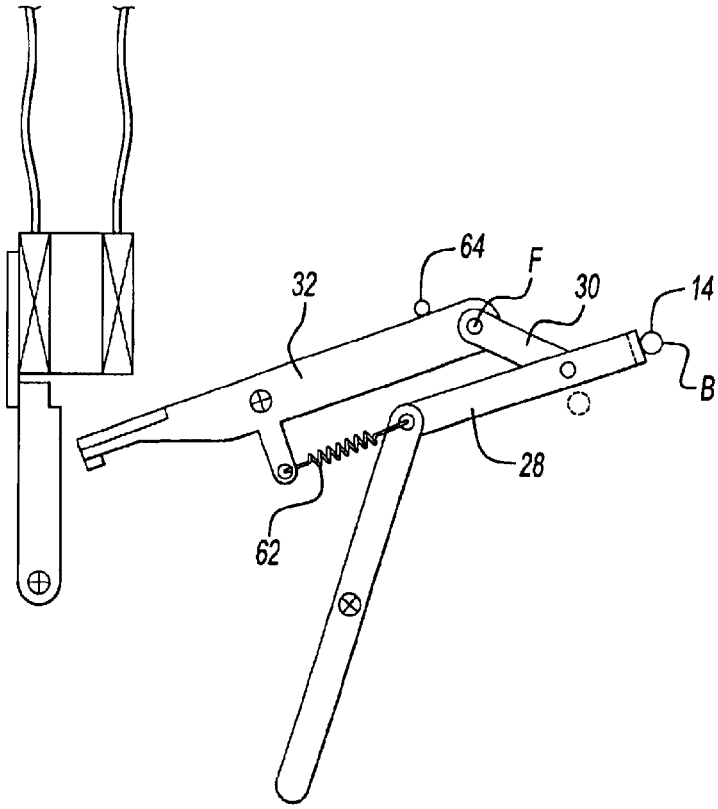
FIG. 3 shows the latch arrangement of FIG. 1 at the end of an opening operation in an unlatched condition.

Further movement of the inside or outside door handle moves the release lever 26 from the position as shown in FIG. 2 to the position as shown in FIG. 3.

In view of the fact that arm 32A of lock/unlock lever 32 is in abutting engagement with abutment 64, lock/unlock lever 32 cannot rotate further in an anticlockwise direction. Thus connector 30 is caused to rotate anticlockwise about pivot F relative to lock/unlock lever 32. This results in abutment 22 of release link 28 moving into engagement with pawl pin 14 and moving it from position A as shown in FIG. 2 to position B as shown in FIG. 3.

As previously mentioned movement of the pawl pin from position A to position B causes the latch to unlock.

When the inside and outside handles are released, spring 60 and spring 62 return the release mechanism 16 and pawl pin 14 to the position as shown in FIG. 1.

Note that whilst the movement of the inside or outside handle and hence movement of the release lever 26 has been described in two stages, such two stage movement is not discernible by a person operating the door handles. Furthermore the mechanism is designed to move seamlessly from the position as shown in FIG. 3 to the position as shown in FIG. 1.

With the control means in its second condition i.e. DC current supplied to the windings in the first direction and the magnetic pawl is in a position as shown in FIG. 1 the lock/unlock lever 32 is maintained in the position as shown in FIG. 1 by magnetic attraction.

Figure 4:
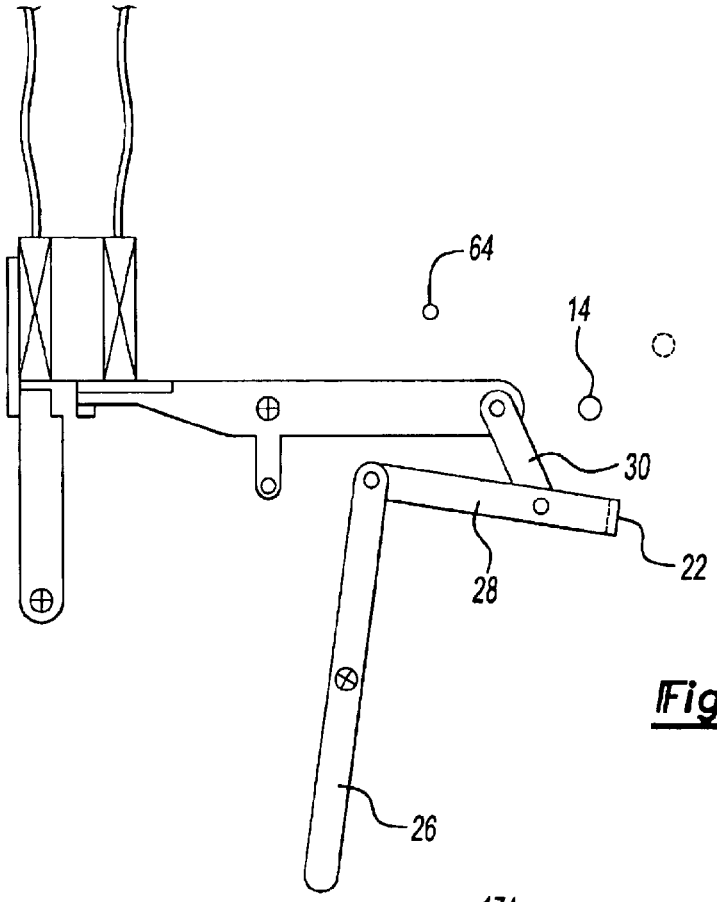
FIG. 4 shows the latch arrangement of FIG. 1 wherein an attempt has been made to open the latch whilst in a locked condition.

Thus operation of an inside or outside door handle will cause the release lever 26 to rotate in a clockwise direction as shown in FIG. 1 which will result in end 28A of release link 28 immediately disengaging pin 37 such that the release lever 26, release link 28 and connector 30 moves to the position as shown in FIG. 4.

It should be noted that whilst abutment 22 has being caused to move, in view of the fact that it was initially mis-aligned with pawl pin 14, such movement has resulted in abutment 22 bypassing pawl pin 14 and not imparting any movement to pawl pin 14. Thus whilst the inside or outside handle has been moved, the door has not become unlatched. Note that in further embodiments it is possible to arrange an abutment such as abutment 22 to be permanently aligned with a latch release element such as pawl pin 42 but remote therefrom such that with the latch arrangement in a locked condition the abutment approaches the pawl pin but does not move it and with the latch arrangement in an unlocked condition the abutment approaches, engages and then moves the pawl pin.

It can be seen that with the control means in its second condition, the door latch remains in a locked condition.

With the control means in the first condition i.e. where there is no power to the windings 46 but the magnetic pawl 44 is in a position as shown in FIG. 1B, anticlockwise rotation of the lock/unlock lever is again prevented though this time by co-operation of abutments 39 and 58. Thus actuation of the inside or outside handles will again cause release lever 26, release link 28 and connector 30 to move to the position as shown in FIG. 4.

Consideration of FIG. 2 shows schematically a power actuator P which is independently operable to release the latch.

Further shown schematically is a coded security device 70 in the form of an externally mounted key barrel into which can be inserted a key. Actuation of the key barrel via the key is capable of moving the magnetic pawl between the positions shown in FIGS. 1A and 1B.

The latch arrangement is configured such that when the associated vehicle is in use the control means is set to its second condition i.e. power is maintained to the windings. Under such circumstances electric power lost to resistance in the windings 46 can be compensated for by the fact that the engine of the vehicle is running and hence the battery recharging system (such as an alternator) can recharge the battery to ensure it does not go flat.

When the vehicle is parked and left unattended the control means can be set to its first condition to lock the latch. Note that the control system does not cause any drain to the vehicle battery in its first condition.

The control mechanism can also be set to its third condition when the vehicle is parked and is required to be in an unlocked condition. Note that in the third condition there is no drain on the battery.

The control means can be changed between its first and third condition by applying a pulse of electrical power to the windings in an appropriate direction.

With the vehicle in use and the control means in its second condition, as mentioned above, the lock/unlock lever 32 is maintained in the position as shown in FIG. 1 by power been fed to the electromagnet. In the event of a power failure, such as might occur following a road traffic accident, the control means will by definition change to its third condition and hence the doors will become unlocked and occupants of the vehicle will be able to escape from the vehicle.

With the vehicle parked and with the control means in its first condition i.e. with the vehicle locked, in the event that the vehicle battery is flattened, perhaps as a result of a interior light being left on, pulsing of the electromagnet to move the control means from the first and third condition to unlock the vehicle will not be possible. However, it is nevertheless possible to manually unlock the vehicle by use of the key and key barrel 70. The key and key barrel can also be used to lock the vehicle if necessary.

It should be noted that only when the vehicle is in use is power continually fed to windings 46. When the vehicle is parked power is only momentarily fed to windings 46 to change between the locked and unlocked condition.

As mentioned above the control means 18 has two ways of preventing rotation of the lock/unlock lever 32, namely by permanently energization of the windings 46 or by movement of magnetic pawl 44 to the position as shown in FIG. 1B. In further embodiments, in particular when no power release P is provided, the control means can be used to simply lock and unlock the vehicle e.g. when parked. As such it is only necessary for the windings 46 to be pulsed to move the magnetic between the positions as shown in FIG. 1A and FIG. 1B. As such the electromagnet 42 is not required to attract lock/unlock lever 32 which can therefore be made of a non ferromagnetic material, such as a plastics material. Under these circumstances it is necessary to have a manual override system operable by the inside handle (but not the outside handle) such that when the inside handle is moved the magnetic pawl 44, if in the position as shown in FIG. 1B, is moved to the position as shown in FIG. 1A. Once the magnetic pawl is in the position as shown in FIG. 1A, the latch release mechanism 16 can then operate in its two stage manner i.e. alignment of abutment 22 with pawl 14 followed by movement of pawl 14 from position A to position B as shown in FIG. 1 to open the latch. Under such an arrangement it is preferable that the release mechanism 16 fully returns to the rest position upon release of the inside handle i.e. abutment 22 becomes mis-aligned with pawl pin 14.

Such an arrangement therefore significantly reduces the likelihood of flattening the battery when the vehicle is parked but the nevertheless allows opening of the doors in the event of power loss following a road traffic accident.

It should be noted that the electromagnet 42 need only be strong enough to retain the lock/unlocked lever 32 in the position shown in FIG. 1 when the electromagnet is in its second condition i.e. when power is being supplied to the electromagnet. Thus the electromagnet has to strong enough to overcome the forces in tension spring 60 during initial movement of inside or outside handle and it has to overcome the forces in tension spring 60 and 62 during a subsequent movement of the inside or outside handle. Note that the electromagnet is not required to be strong enough to move the lock/unlock lever from the position as shown in FIG. 2 to a position such that abutment 38 engages with the electromagnet.

Figure 5:
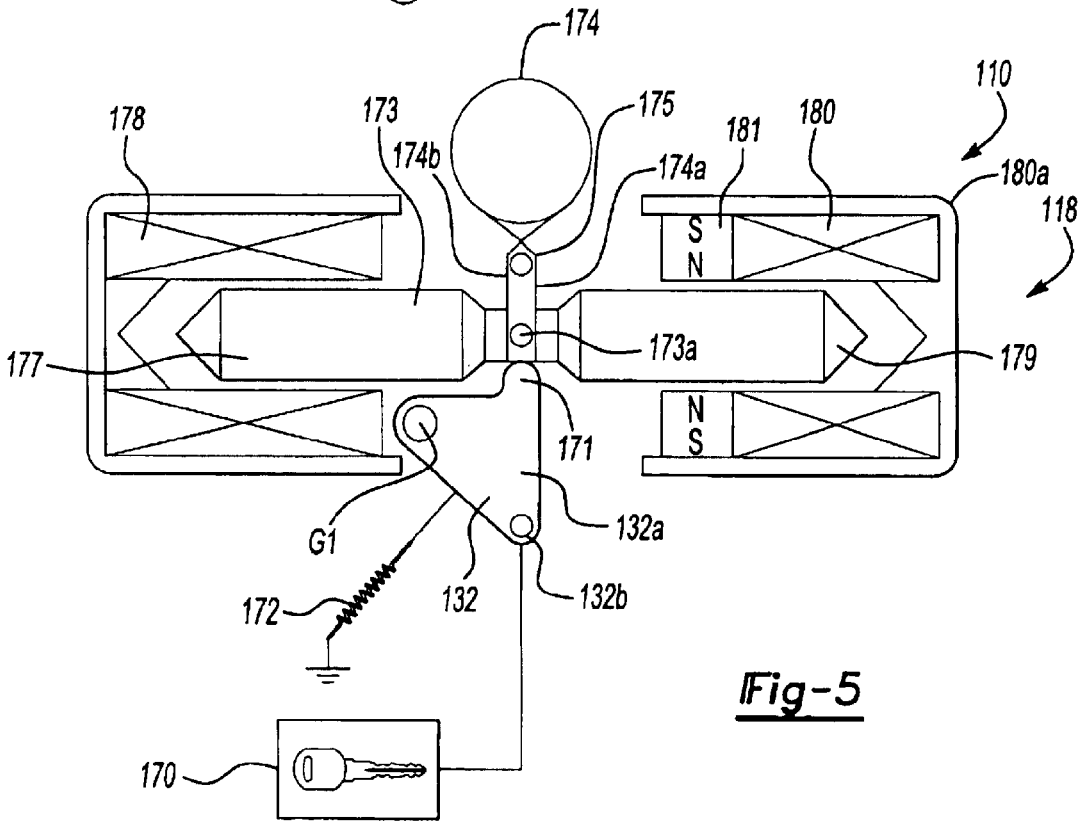
FIGS. 5 and 5A shows a further embodiment of a latch arrangement according to the present invention.

With reference to FIG. 5 there is shown various components of a further latch arrangement 110. Lock/unlock lever 132 is pivotally mounted about pivot G1 and includes a portion 132A having a hole 132B for connection to further parts of the release mechanism (not shown).

Lock/unlock lever 132 further includes a cam follower 171. Lock/unlock lever 132 is biased in an anticlockwise direction by spring 172. Lock/unlock lever 132 can be moved between a locked and unlocked condition by a coded security device in the form of a key and key barrel 170 (shown schematically).

Figure 5A:
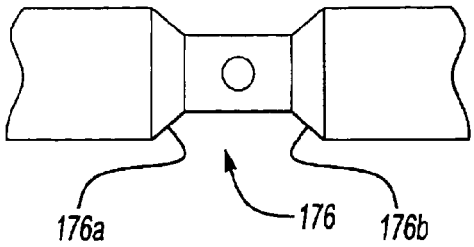

Powered control means 118 includes an axially movable armature 173 which is biased to a central position (as shown in FIG. 5) by arms 174A and 174B of centring spring 174 acting on pin 173A of armature 173 and also on pin 175 mounted on a chassis of the latch arrangement. Armature 173 includes a wasted portion 176 (see FIG. 5A) having cam surfaces 176A and 176B both in the form of frustoconical surfaces.

End 177 of the armature is positioned within windings 178 and end 179 of the armature is positioned within windings 180 to provide for a solenoid arrangement. In particular adjacent the left hand end of windings 180 are permanent magnets 181.

Operation of the latch arrangement 110 is as follows. When the vehicle upon which latch arrangement 110 is mounted is in use and is required to be in a locked condition, power is supplied and maintained to windings 178 in such a manner that the armature moves to the left as shown in FIG. 5 resulting in cam follower 171 being biased radially outwards relative to the axis of the armature by surface 176B such that lock/unlock lever 132 is rotated clockwise to a locked position. In the event of a road traffic accident, where the power to the windings 178 is cut, the centering spring 174 returns the armature to the position as shown in FIG. 5 and spring 172 therefore returns the lock/unlock lever 132 to the position as shown in FIG. 5 thus unlocking the door and allowing access to egress to or from the vehicle.

In the event that the vehicle is to be left in a parked and locked condition, a pulse of power is provided to the windings 180 in such a manner that the armature moves to the right as shown in FIG. 5. However, under these circumstances, because of a flux loop created by the winding housing 180A in conjunction with magnets 181 and the right hand portion of armature 173, the armature 173 remains in the right hand position even when no current flows in windings 180.

Thus it can be seen that it is possible to lock the vehicle when parked and no power is being drained from the vehicle battery whilst parked and locked.

In the event that the vehicle is to be unlocked, a pulse of power is supplied to windings 180 such that the armature moves to the left and achieves the position as shown in FIG. 5.

In further embodiments, a cam arrangement can be used, such as a desmadromic cam arrangement, in place of spring 172 in order that the lock/unlock lever is returned to the position as shown in FIG. 5 as the armature is returned to its central position.

Figure 6:
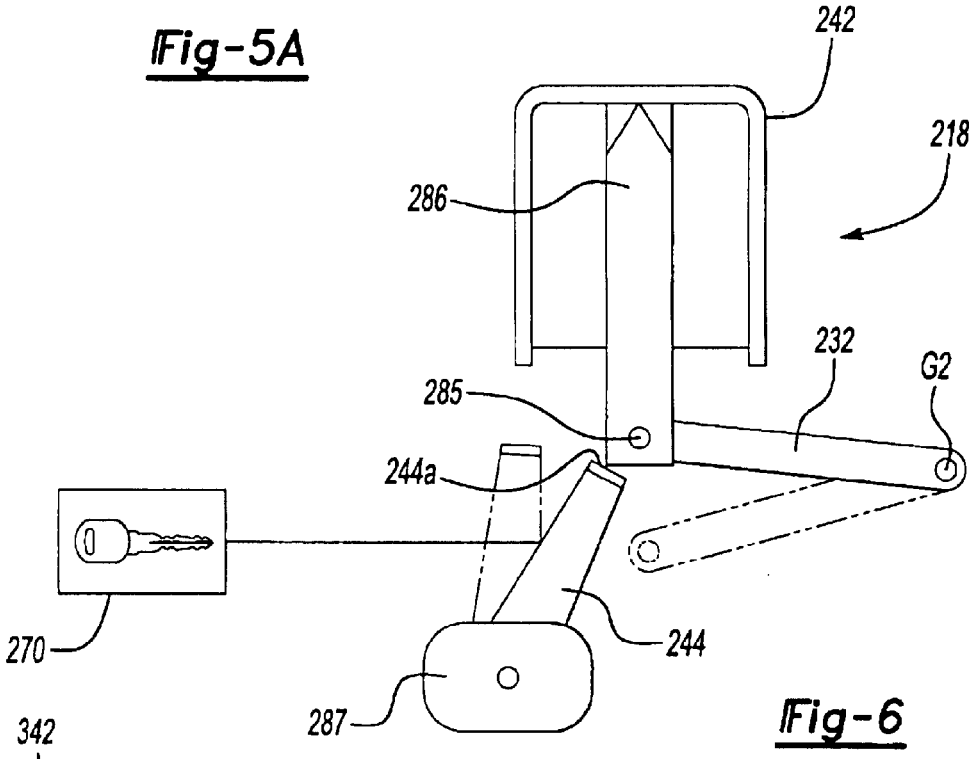
FIG. 6 shows a further embodiment of a latch arrangement according to the present invention.

With reference to FIG. 6 there is a shown a further embodiment of a powered control means 218 in which a lock/unlock lever 232 is pivotally mounted about axis G2 and is connected by pin 285 to armature 286 of solenoid 242. A motor 287 moves pawl 244 between an unlocked position (shown chain dotted) and a locked position wherein end 244A of pawl 244 is aligned with armature 286 such that it is prevented from moving downwards as shown in FIG. 6 from the locked position of lock/unlock lever 232 to the unlocked position (shown chain dotted).

A key and key barrel 270 can be used to move the pawl 244 between its locked and unlocked positions.

Note that in this case the solenoid 242 is required to move the lock/unlock lever from the unlocked position to the locked position.

Figure 7:
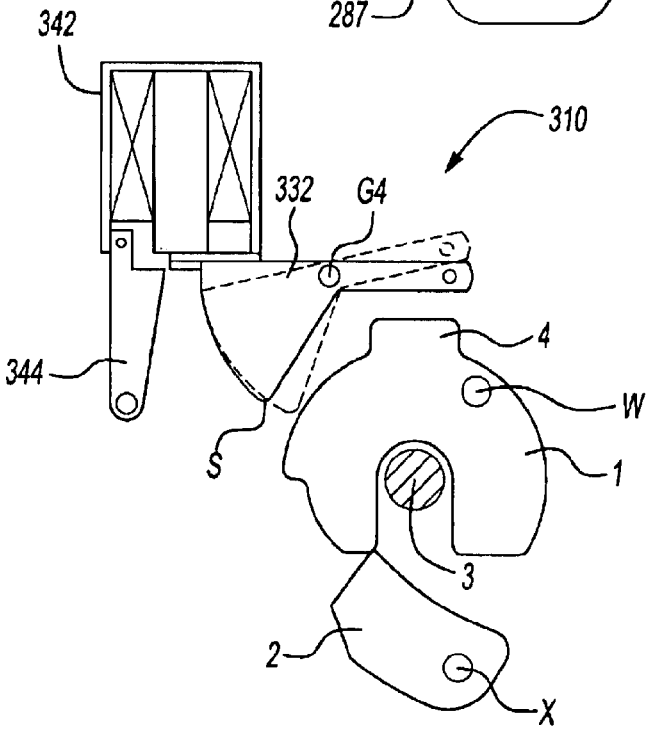
FIGS. 7 to 7D shows a further embodiment of a latch arrangement according to the present invention.
Figure 7A:
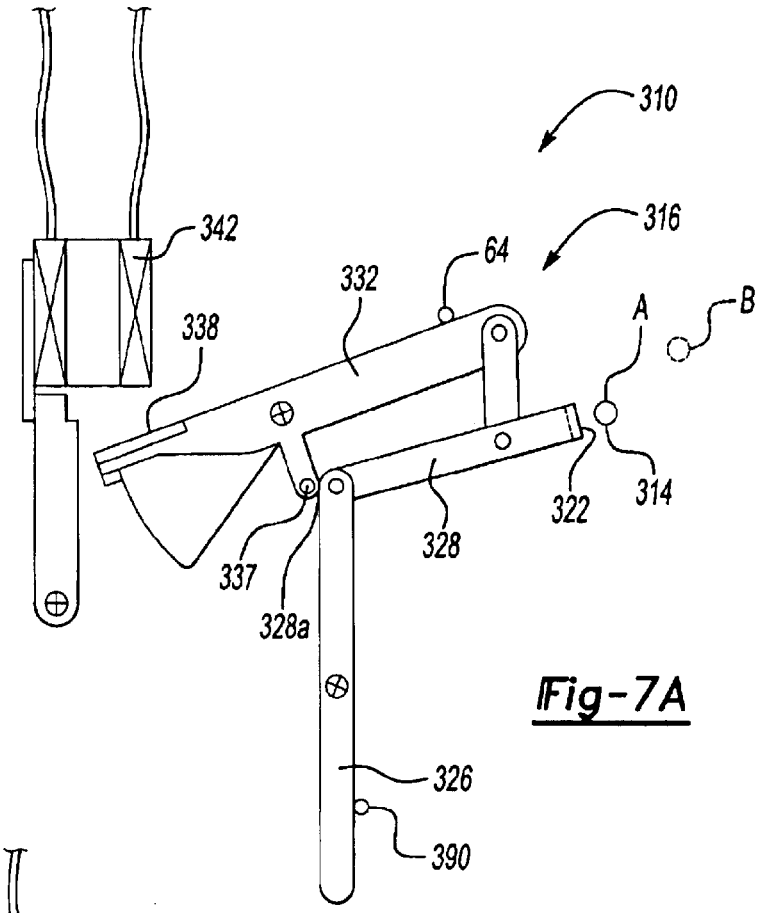
Figure 7B:
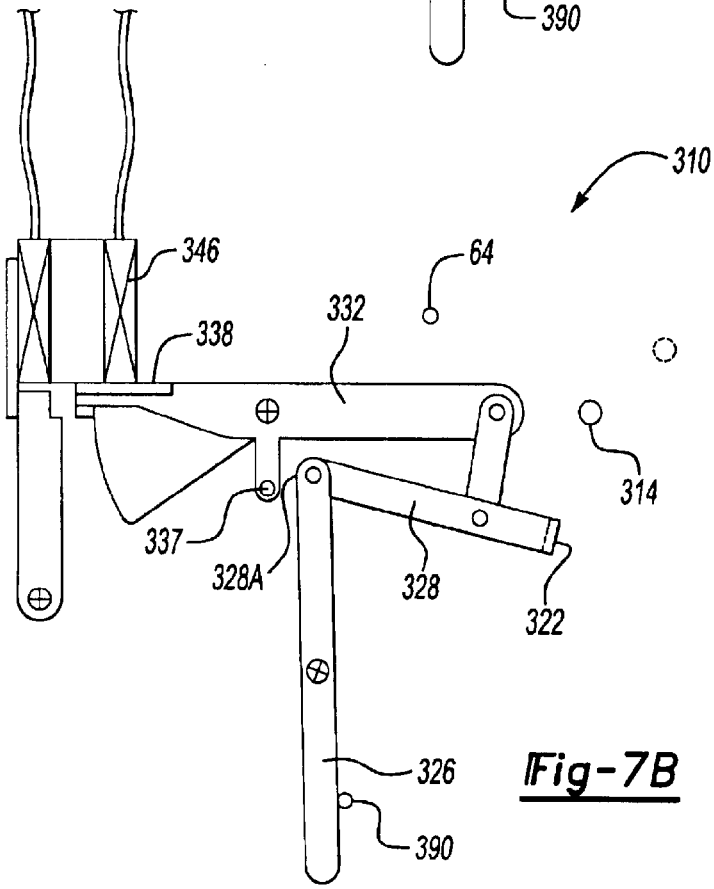
Figure 7C:
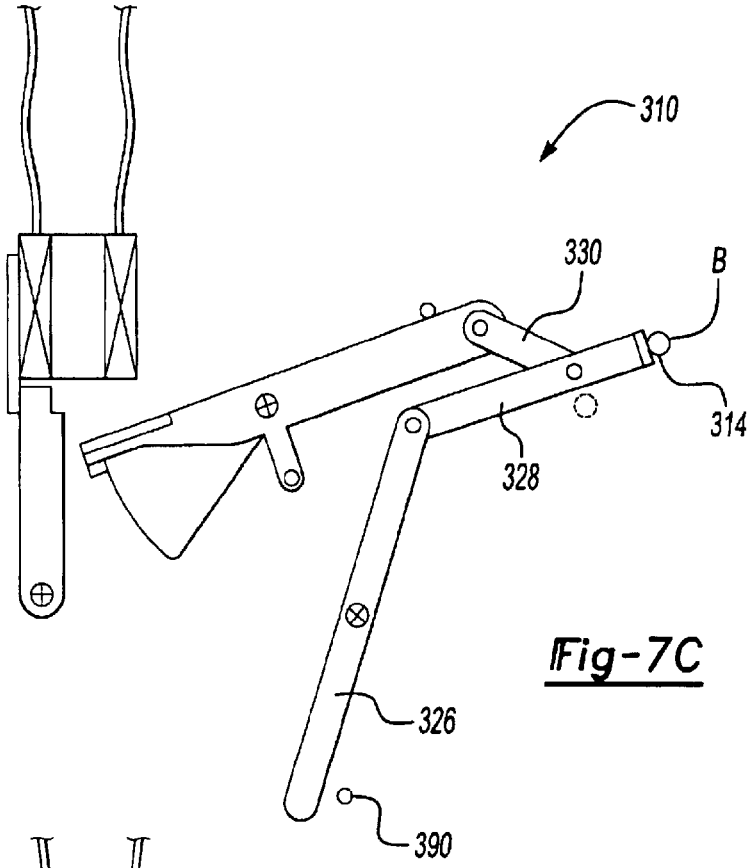
Figure 7D:
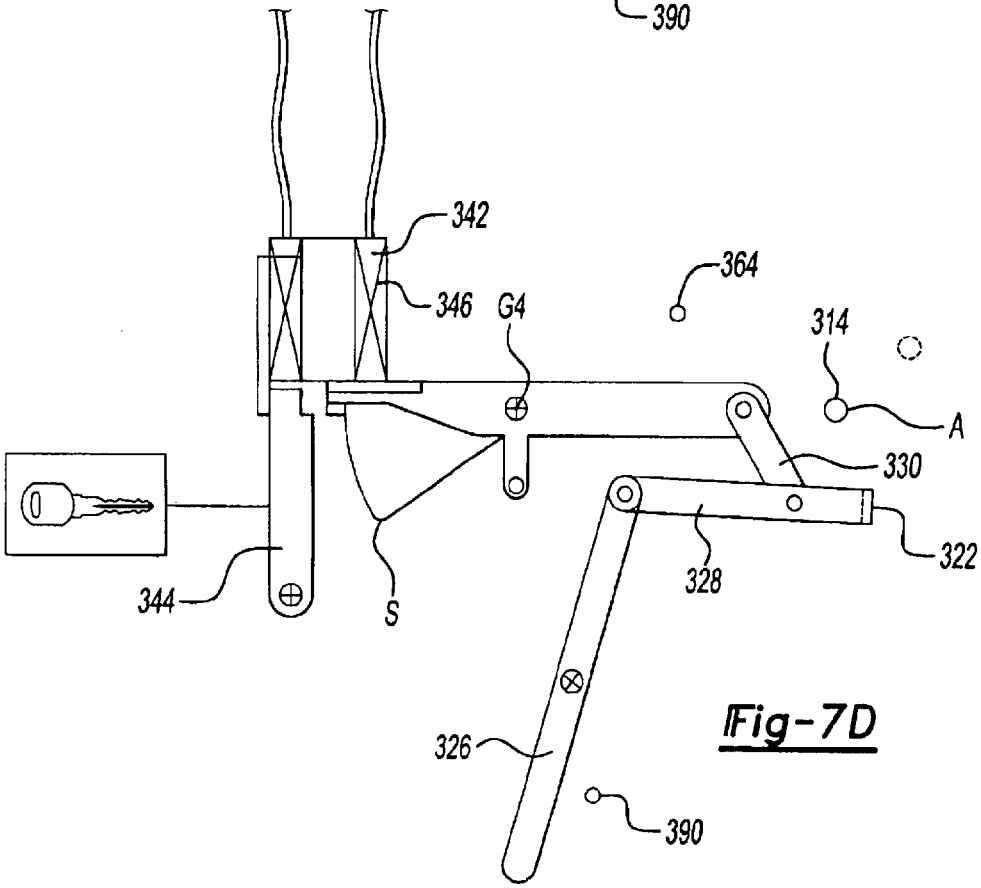

With reference to FIGS. 7 to 7D there is shown a further embodiment of a latch arrangement 310 having components which fulfill substantially the same function a those in latch arrangement 10 labeled 300 greater. Further shown is a latch bolt in the form of a rotating claw 1 pivotably mounted about pivot W which is retained in the position as shown in FIG. 7 by pawl 2 which is pivotably mounted about pivot X. A striker 3 can be retained in the position as shown in FIG. 7 to latch a door in a closed position. In this case claw 1 includes a cam lug 4 on the outer periphery thereof which engages with lug 5 of lock/unlock lever 332 as will be further described below.

In this case there is further included an abutment 390 which limits anticlockwise rotation of release lever 326.

FIG. 7A shows the latch arrangement 310 in an unlocked condition wherein release lever 326 is in abutment with abutment 390, lock/unlock lever 332 is in abutment with abutment 64 and end 328A of release link 328 is in abutment with pin 337 with abutment 338 being remote from electromagnet 342. In this position abutment 322 aligns with pin 314. Note that the position of components shown in FIG. 7A is equivalent to the position of similar components as shown in FIG. 2.

FIG. 7B shows the latch arrangement 310 in a locked condition wherein electrical power is fed to windings 346 to maintain abutment 338 in engagement with the electromagnet. Note that release lever 326 is still in engagement with abutment 390 whilst lock/unlock lever 332 is no longer in engagement with abutment 64 and end 328A of release link 328 is no longer in engagement with pin 337. Note also that abutment 332 is now mis-aligned with pawl pin 314. Thus pivotal movement of the release lever 326 in a clockwise direction will cause abutment 322 to bypass pin 314 and thus the door will remain closed.

Consideration of FIG. 7A shows that in the event that the release lever 326 is pivoted in a clockwise direction so as to disengage abutment 390, the release lever 326, release link 328, and connector 330 will move to the position as shown in FIG. 7C resulting in abutment 322 engaging and moving pin 314 to position B as shown in FIG. 7C, thus allowing the door the to open.

It should be noted that the latch arrangement 310 only momentarily achieves the position as shown in FIG. 7C since once in this position the claw 1 rotates anticlockwise about pivot W which simultaneously releases the striker 3 from the mouth of the claw and also causes cam lug 4 to contact lug 5 thus driving the lock/unlock lever to the position as shown in FIG. 7D. This in turn allows the pawl pin 314 to return to position A and causes the connector 330 and release link 328 to adopt the position as shown in figure Note that as shown in FIG. 7D, the release lever is disengaged from abutment 390 i.e. an inside or outside door handle is still in an actuated position.

With the inside or outside handle in its actuated position, the door latch can then be locked either by supplying an maintaining power to windings 346 or by pulsing windings 346 such that pawl 344 moves clockwise to a position equivalent to that shown in FIG. 1B or by manual operation of the key again moving pawl 344. Subsequent release of the inside or outside door handle will either return the latch arrangement to the position as shown in FIG. 7B (when power is supplied and maintained to windings 346) or to the position as shown in FIG. 7B except with the pawl moved across.

Alternatively where no power is supplied to windings 346 then neither the electromagnet or pawl 344 will restrict rotational movement of the lock/unlock lever 332 which, upon release of the inside or outside door handle will return to the position as shown in FIG. 7C.

It can be seen that electromagnet 342 is therefore only required to hold the lock/unlocked lever in the locked position as shown in FIG. 7 and is not required to return it to that position from the unlocked position since this is carried out by co-operation between cam lug 4 and lug 5.

In an alternative embodiment it is possible to provide an electromagnet which is sufficiently powerful to move the lock/unlock lever from the position as shown in FIG. 7A to the position as shown in FIG. 7B so as to be able to lock the door without having to open the door.

What is claimed is:

1. A latch arrangement including a latch, a manually actuable element, a release mechanism and a power control means, the latch being operable to releasably retain a striker in use, the release mechanism being capable of being moved by the manually actuable element from a latched position to an unlatched position wherein it unlatches the latch, the power control means having a first, second and third condition in which;

with the power control means in the first condition the power control means is in a non powered condition and actuation of the manually actuable element does not cause the release mechanism to unlatch the latch, said power control means remains in said non powered condition during actuation of the manually actuable element, with the power control means in the second condition the powered control means is in a powered condition and actuation of the manually actuable element does not cause the release mechanism to unlatch the latch, and with the power control means in the third condition the power control means is in a non powered condition and actuation of the manually actuable element causes the release mechanism to unlatch the latch.

2. A latch arrangement as defined in claim 1 in which a part of the release mechanism is retained in a locked position by the power control means to provide for a lock condition of the latch.

3. A latch arrangement as defined in claim 2 in which said part of the release mechanism is retained by magnetic attraction.

4. A latch arrangement as defined in claim 2 in which said part of the release mechanism is retained by a pawl.

5. A latch arrangement as defined in claim 2 in which said part of the release mechanism is a lock/unlock lever which is retained in a first position by the power control means to provide for the lock condition and is allowed to move to a second position to provide for the unlocked condition.

6. A latch arrangement as defined in claims 2 in which the power control means includes an electromagnet to retain said part of the release mechanism in the unlocked position.

7. A latch arrangement as defined in claim 6 in which the electromagnet is incapable of moving the said part of the release mechanism from the unlocked to the locked position.

8. A latch arrangement as defined in claim 1 in which the power control means includes a magnetic pawl movable between a locked and unlocked position.

9. A latch arrangement as defined in claim 8 in which the electromagnet is pulsed to move the pawl between the locked and unlocked position.

10. A latch arrangement as defined in claim 8 in which the pawl is pivotally movable and the center of gravity of the pawl is substantially at the axis of the pivot.

11. A latch arrangement as defined in claim 1 in which the release mechanism is designed to return to a rest position from a release position upon release of the manually actuable element.

12. A latch arrangement as defined in claim 11 in which the release mechanism is biased to the rest position by resilient means.

13. A latch arrangement as defined in claim 12 in which a first resilient means biases the release mechanism to the unlocked position from the released position and a second resilient means biases the release mechanism to the rest position from the unlock position.

14. A latch arrangement as defined in claim 1 in which unlatching of the latch arrangement causes the release mechanism to move to a locked condition.

15. A latch arrangement as defined in claim 13 in which the release mechanism can be retained in the locked condition whilst the latch is in its unlatched condition.

16. A latch arrangement as defined in claim 14 in which the release mechanism is retained in the locked condition by putting the power control means into the first condition.

17. A latch arrangement as defined in claim 14 in which the release mechanism is retained in the locked condition by putting the power control means into the second condition.

18. A latch arrangement as defined in claim 1 in which the latch is further movable between a latched and released position by a powered released actuator.

19. A latch arrangement as defined in claim 1 in which the power control means is movable between the locked and unlocked conditions by manual operation of a coded security device.

20. A latch arrangement as defined in claim 19 in which said coded security device is a key.

* * * * *